US006206063B1

(12) United States Patent
Lin

(10) Patent No.: US 6,206,063 B1
(45) Date of Patent: Mar. 27, 2001

(54) MULTIFUNCTIONAL WORK BOX

(76) Inventor: Hsin-Yun Lin, No. 17, Chuan Yuan Street, Taichung (TW)

( * ) Notice: Subject to any disclaimer, the term of this patent is extended or adjusted under 35 U.S.C. 154(b) by 0 days.

(21) Appl. No.: 09/480,632

(22) Filed: Jan. 10, 2000

(51) Int. Cl.[7] ..... B25H 1/12
(52) U.S. Cl. ..... 144/285; 144/286.5
(58) Field of Search ..... 144/285, 286.1, 144/286.5; 206/373, 216

(56) References Cited

U.S. PATENT DOCUMENTS 2,587,829 * 3/1952 Fox et al. ..... 144/285
2,610,761 * 9/1952 Fleming ..... 144/285
2,740,517 * 4/1956 Evans ..... 144/285
4,252,239 * 2/1981 Snyder ..... 144/285
4,733,703 * 3/1988 Cimino ..... 144/285
5,329,929 * 7/1994 Miller et al. ..... 144/285
5,595,228 * 1/1997 Meisner et al. ..... 144/285

* cited by examiner

*Primary Examiner*—W. Donald Bray
(74) *Attorney, Agent, or Firm*—Browdy and Neimark

(57) ABSTRACT

A multifunctional work box comprises a base and a face board pivoted to the top of the base. The base has a receiving compartment with an opening facing upward. The compartment is intended to keep hand tools. The face board is used to cover the compartment and to serve as a workpiece platform. The face board can be swiveled to enable its underside to face upward.

20 Claims, 6 Drawing Sheets

MULTIFUNCTIONAL WORK BOX

FIELD OF THE INVENTION

The present invention relates generally to a work box, and more particularly to a multifunctional work box which can be used as a workbench, a workpiece holder, a tool container, etc.

BACKGROUND OF THE INVENTION

The conventional workbench is limited in design in that it can not be used as a tool container. Similarly, the conventional tool box is designed simply for keeping the tool; it is not provided with means enabling it to be used as a workbench, a workpiece holder, and so forth. In addition, the conventional workbench or tool box can not be carried around easily.

SUMMARY OF THE INVENTION

The primary objective of the present invention is to provide a multifunctional work box which is designed for use as a tool box, a workbench, a workpiece holder, etc.

It is another objective of the present invention to provide a multifunctional work box which can be easily carried around.

In keeping with the principle of the present invention, the foregoing objectives of the present invention are attained by a multifunctional work box comprising a base and a face board pivoted to the top of the base. The base is provided with a receiving compartment having an open top. The face board may be used as a workbench. The face board is provided on the upper surface thereof with a cutting auxiliary device, and in the underside thereof with a clamp for holding a workpiece.

DETAILED DESCRIPTION OF THE INVENTION

Figure 1:
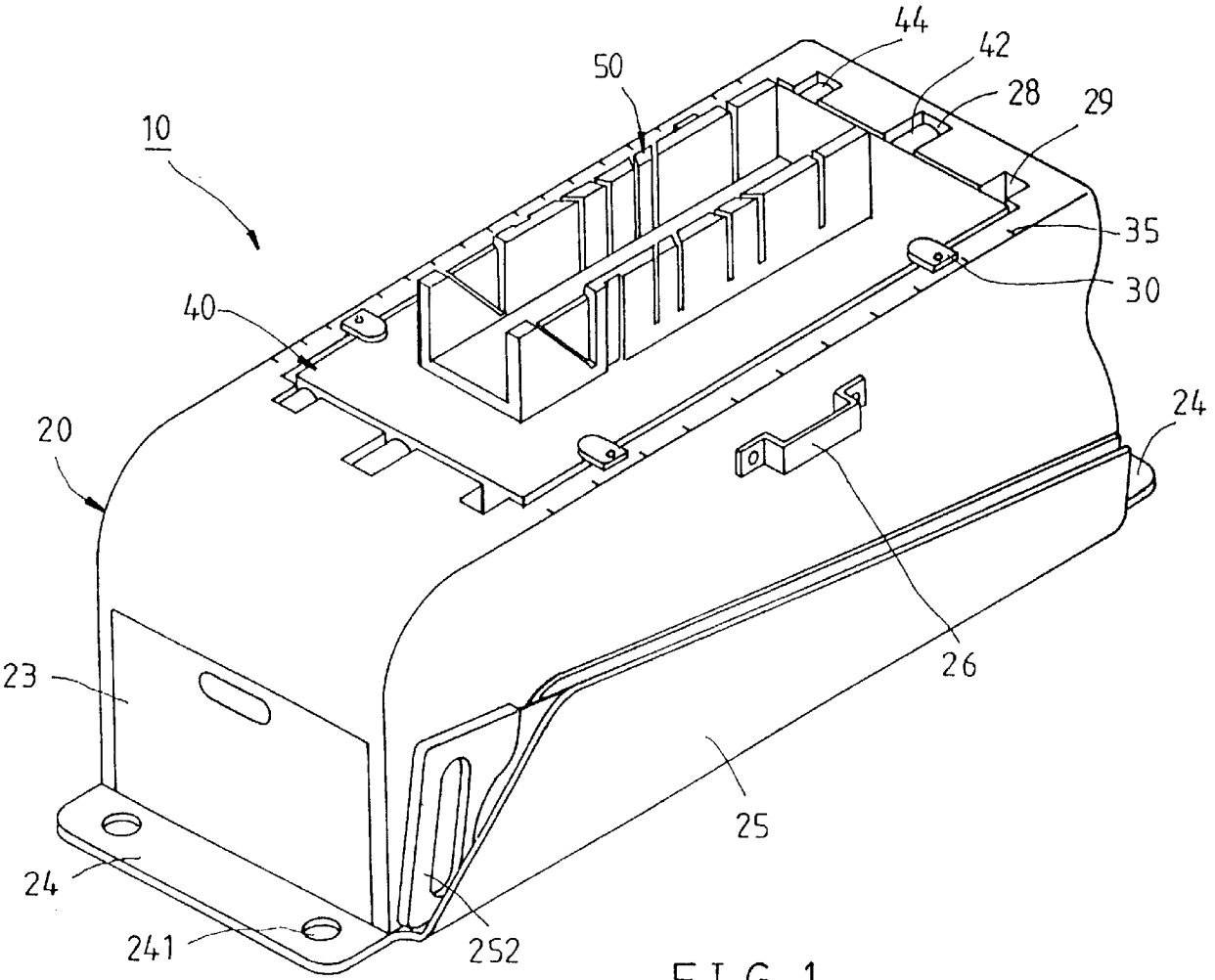
FIG. 1 shows a perspective view of a preferred embodiment of the present invention.
Figure 2:
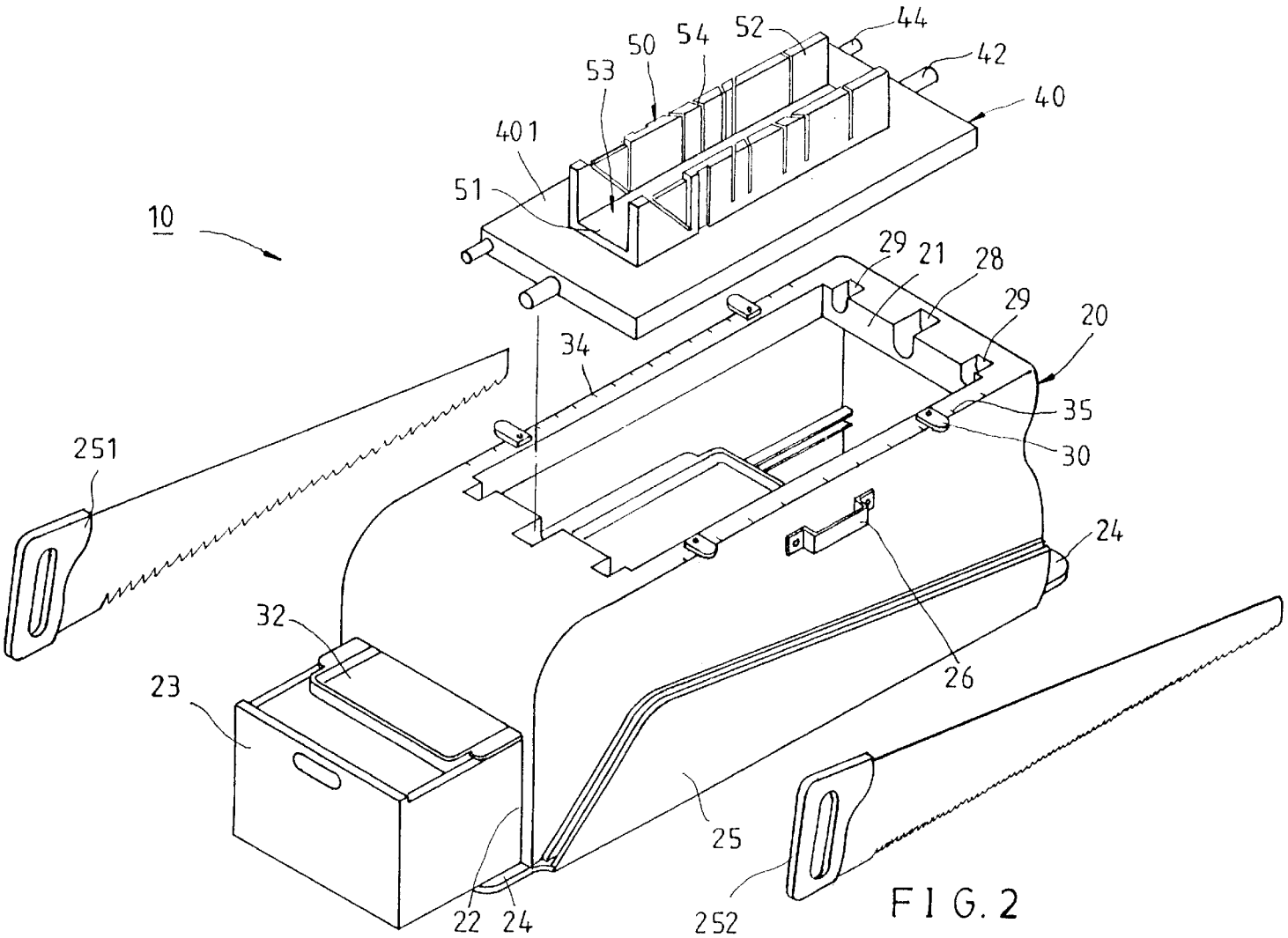
FIG. 2 shows an exploded view of the preferred embodiment of the present invention.
Figure 3:
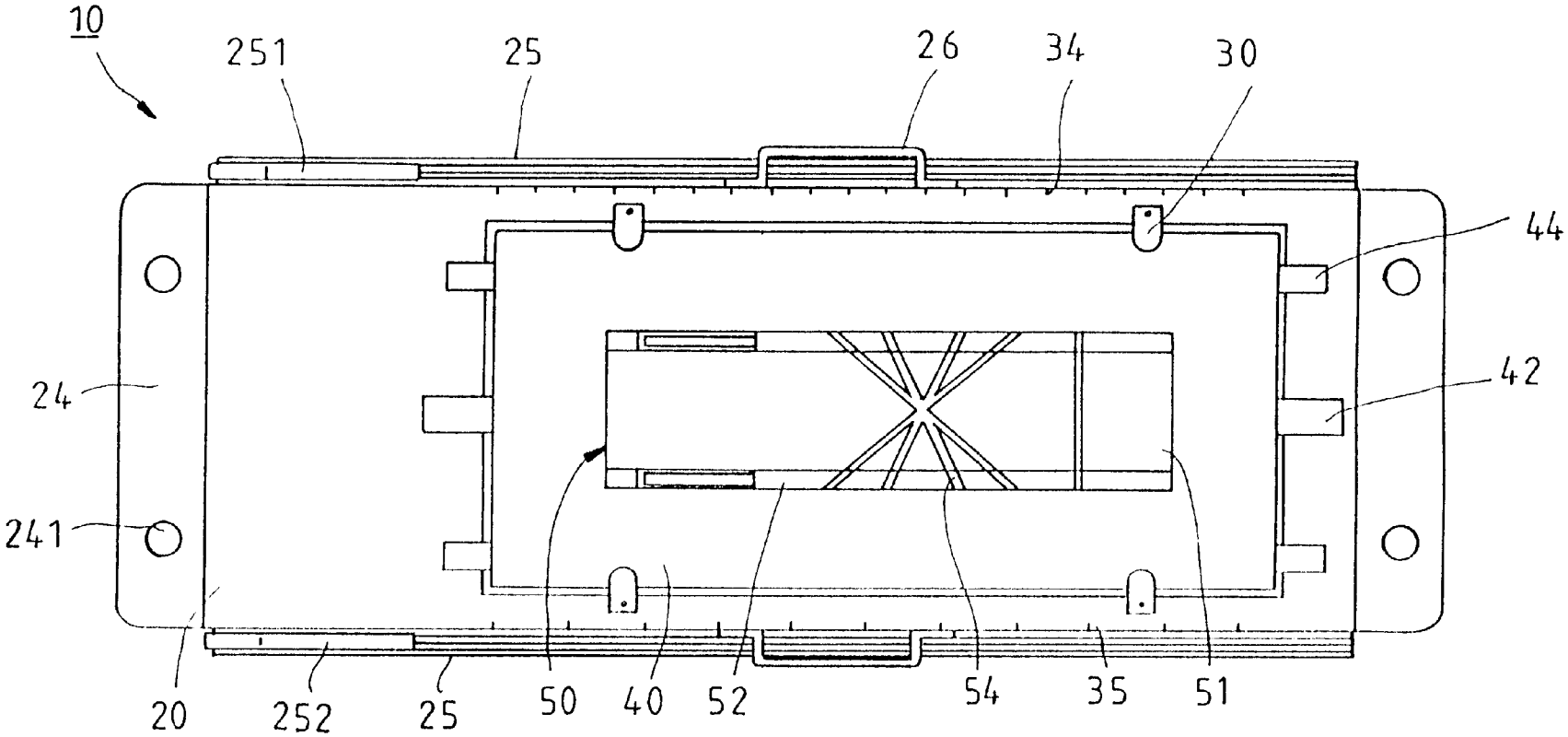
FIG. 3 shows a top view of the preferred embodiment of the present invention.
Figure 5:
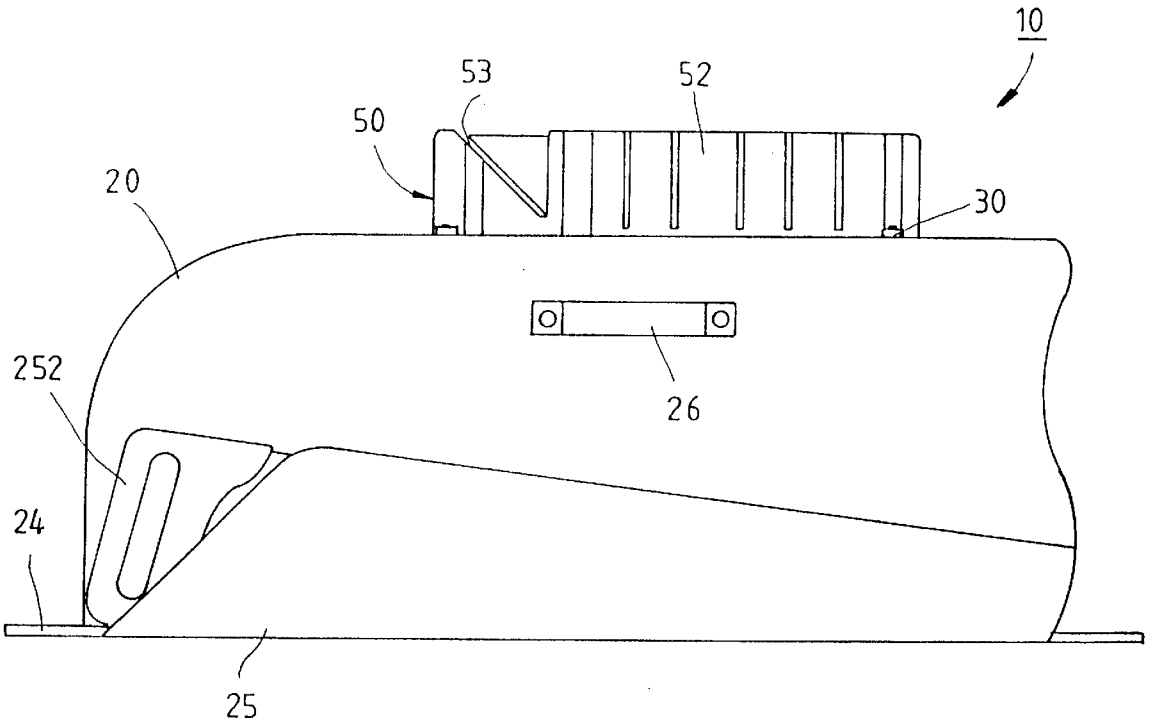
FIG. 5 shows a front schematic view of the preferred embodiment of the present invention in the state of a first type of use.
Figure 4:
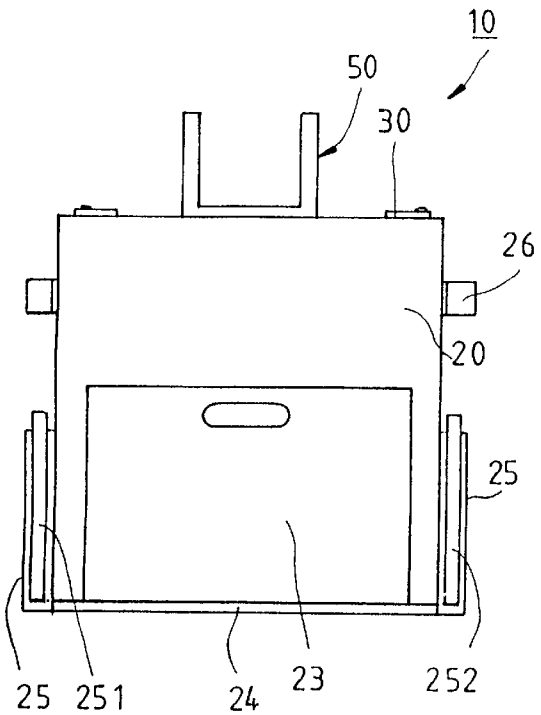
FIG. 4 shows a side view of the preferred embodiment of the present invention.
Figure 6:
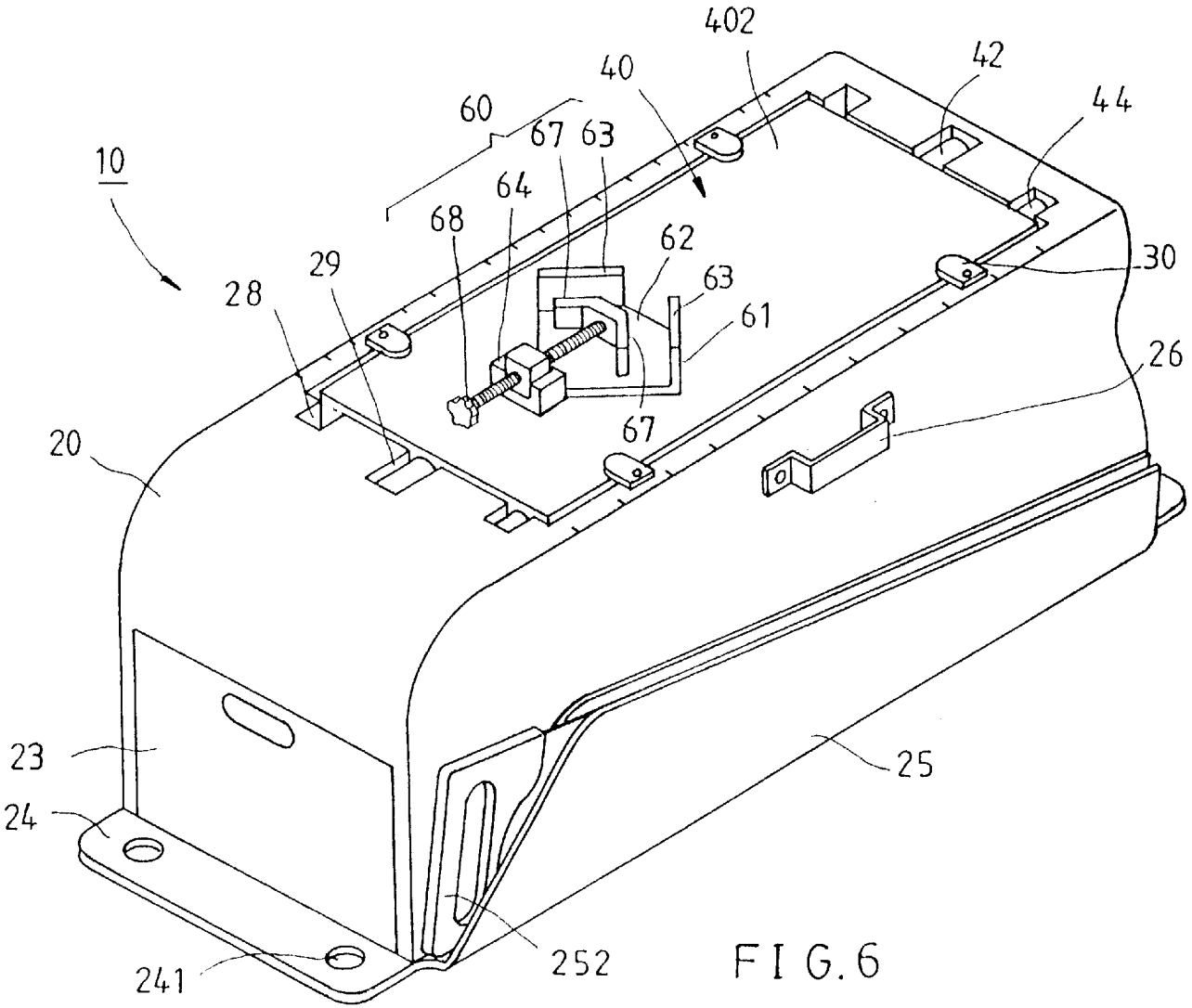
FIG. 6 shows a perspective view of the preferred embodiment of the present invention in the state of a second type of use.

As shown in all drawings provided herewith, a work box 10 embodied in the present invention comprises a base 20, a face board 40, a cutting auxiliary device 50, and a clamp 60.

The base 20 has a receiving compartment with an open top 21. The compartment is provided in the front side wall thereof with a front opening 22 via which a drawer 23 is received in the compartment. The drawer 23 is intended to contain tools and articles. The compartment is provided in the bottom edge of the front side wall thereof and the bottom edge of the rear side wall thereof with a locating plate 24 which is provided with two through holes 241. The work box 10 can be thus fastened on a workbench by a plurality of fastening bolts, which are received in the through holes 241 of the two locating plates 24. The compartment of the base 20 is further provided in the left side wall thereof and the right side wall thereof with a saw receiver 25 of a U-shaped cross section for keeping a rough saw 251 and a finishing saw 252. The base 20 is further provided in the left and the right side wall thereof with a handle 26 to facilitate the holding and the moving of the work box 10 with the hands.

The face board 40 is of a rectangular construction and is disposed in the open top 21 of the compartment of the base 20. The face board 40 is provided at the center of two short sides thereof with a pivot 42. The base 20 is provided with two pivot slots 28 corresponding in location to the two pivots 42 of the face board 40. The face board 40 is fastened pivotally with the base 20 by the pivots 42 which are received in the pivot slots 28. The compartment of the base 20 is covered by the face board 40. The face board 40 is provided respectively in two short sides thereof with a retaining pillar 44 which is separated from the pivot 42 by a predetermined distance. The base 20 is provided in the top end thereof with four retaining slots 29 corresponding in location to the retaining pillars 44. When the upper surface 401 or the underside 402 of the face board 40 faces upward, the retaining pillars 44 are received in the retaining slots 29 so as to locate the face board 40. The base 20 is further provided in the top end thereof with two retaining pieces 30 fastened pivotally therewith such that the retaining pieces 30 can be swiveled to engage the upper surface of the face board 40 so as to fix the face board 40 which is used as a workbench platform.

The cutting auxiliary device 50 comprises a rectangular bottom plate 51 which is disposed on the upper surface 401 of the face board 40, and two side plates 52 extending upright from two sides of the bottom plate 51, thereby resulting in the formation of the cutting space 53 which is defined by the bottom plate 51 and the side plates 52 and is intended to accommodate a workpiece. The two side plates 52 are provided with six tangent slots 54, which are formed in pair and in six sets, with two tangent slots 54 of any one set being coplanar for receiving a saw blade. The saw blade is capable of working on a workpiece in various angles.

The clamp 60 comprises an outer clamp body 61, an inner clamp body 66, and a threaded rod 68. The outer clamp body 61 is formed of a bottom plate 62 which is disposed in the underside 402 of the face board 40, two clamping plates 63 forming therebetween an angle of 90 degrees and extending upright from the bottom plate 62, and a threaded rod seat 64 disposed on the bottom plate 62 for setting up the threaded rod 68. The inner clamp body 66 has two clamping surfaces 67 parallel to the two clamping plates 63 of the outer clamp body 61. The inner clamp body 66 is connected with one end of the threaded rod and is driven by the threaded rod to displace toward the two clamping plates 63. A workpiece 69 is therefore held securely in place by the inner clamp body 66 and the outer clamp body 61.

The drawer 23 of the base 20 is provided in the top thereof with a tray 32 for collecting the minute particles, such as sawdust. The base 20 is provided in two sides of the top thereof with a metric scale 34 and a British scale 35 for measuring the length of the workpiece.

Figure 7:
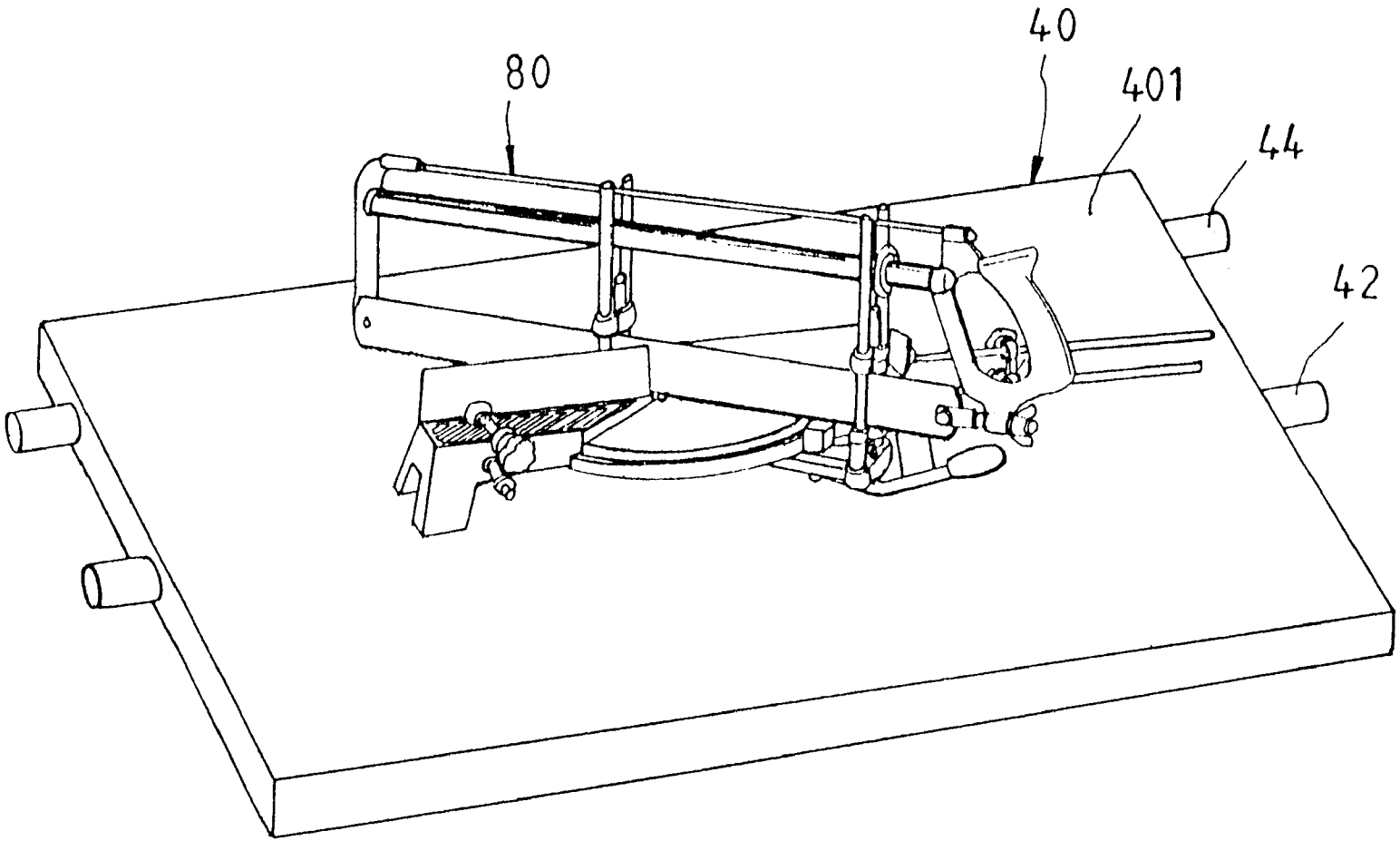
FIG. 7 shows a partial perspective view of the present invention provided with another cutting auxiliary device.

The face board 40 may be provided with another cutting auxiliary device 80 as shown in FIG. 7, or an angle gauge, in place of the cutting auxiliary device 50 and the clamp 60.

What is claimed is:

1. A multifunctional work box comprising:

a base having a receiving compartment with an open top whereby said compartment is used to receive at least one article; and a face board pivoted to a top end of said base for covering said compartment and used as a workbench platform whereby said face board can be swiveled such that n upper surface thereof or an underside thereof faces upward wherein said face board is of a rectangular construction and is provided in two longitudinal sides thereof with a pivot; and wherein said base is provided in a top end thereof with two pivot slots corresponding in location to said pivots; and wherein said face board is provided in two longitudinal sides thereof with a retaining pillar which is separated from said pivot by a predetermined distance; and wherein said base is provided in the top end thereof with four retaining slots corresponding in location to said two retaining pillars whereby said retaining pillars are received in said retaining slots at the time when the upper surface or the underside of said face board faces upward.

2. The work box as defined in claim 1 further comprising a cutting auxiliary device mounted on the upper surface of said face board.

3. The work box as defined in claim 2, wherein said cutting auxiliary device comprises a bottom plate disposed on said face board, and two side plates extending upright from two opposite sides thereof such that a cutting space is formed and defined by said bottom plate and said two side plates for accommodating a workpiece whereby said two side plates are provided with at least one tangent slot for receiving a saw blade, with said tangent slots of said two side plates being coplanar.

4. The work box as defined in claim 1 further comprising a clamp mounted in the underside of said face board for holding a workpiece on place.

5. The work box as defined in claim 4, wherein said clamp comprises an outer clamp body, and inner clamp body, and a threaded rod, said outer clamp body being formed of a bottom plate disposed in the underside of said face board, two clamping plates forming a predetermined angle and extending upright from said bottom plate, and a threaded rod seat mounted on said bottom plate for securing said threaded rod, said inner clamp body having two clamping surfaces parallel to said clamping plates of said outer clamp body whereby said inner clamp body is connected with one end of said threaded rod such that said inner clamp body is driven by said threaded rod to displace toward said two clamping plates, so as to hold the workpiece between said inner clamp body and said outer clamp body.

6. The work box as defined a claim 5, wherein said angle formed by said two clamping plates is preferably 90 degrees.

7. The work box as defined in claim 2, wherein said face board is of a rectangular construction and is provided in two longitudinal sides thereof with a pivot; and wherein said base is provided in a top end thereof with two pivot slots corresponding in location to said pivots.

8. The work box as defined in claim 7, wherein said face board is provided in two longitudinal sides thereof with a retaining pillar which is separated from said pivot by a predetermined distance; and wherein said base is provided in the top end thereof with four retaining slots corresponding in location to said two retaining pillars whereby said retaining pillars are received in said retaining slots at the time when the upper surface or the underside of said face board faces upward.

9. The work box as defined in claim 1, wherein said base is provided in a top end thereof with at least one retaining piece fastened pivotally therewith such that said retaining piece can be rotate to engage the upper surface of said face board.

10. The work box as defined in claim 9 further comprising four retaining pieces disposed in pair on two opposite sides of the top end of said base.

11. The work box as defined in claim 1, wherein said base is provided in one side wall thereof with an opening in communication with said compartment for disposing a drawer in said compartment via said opening.

12. The work box as defined in claim 11, wherein a top of said drawer is provided in with a tray for collecting dust passing through a gap between said base and said face board.

13. The work box as defined in claim 1, wherein said base is provided in one side wall thereof with a saw receiver of a U-shaped cross section for keeping a saw.

14. The work box as defined in claim 1, wherein said base is provided in a bottom edge of two opposite side walls thereof with a locating plate which is provided with at least one through hole for receiving a fastening bolt whereby said fastening bolt is used to fasten said base on a workbench platform.

15. The work box as defined in claim 1, wherein said base is provided in two opposite side walls thereof with a handle to facilitate the holding of said base with the hands of a person.

16. The work box as defined in claim 1, wherein said base is provided in a top thereof with a metric or British scale.

17. A multifunctional work box comprising:

a base having a receiving compartment with an open top whereby said compartment is used to receive at least one article; and a face board pivoted to a top end of said base for covering said compartment and used as a workbench platform whereby said face board can be swiveled such that an upper surface thereof or an underside thereof faces upward;

wherein said base is provided in a tip end thereof with at least one retaining piece fastened pivotally therewith such that said retaining piece can be rotated to engage the upper surface of said face board.

18. A multifunctional work box comprising:

a base having a receiving compartment with an open top whereby said compartment is used to receive at least one article; and a face board pivoted to a top end of said base for covering said compartment and used as a workbench platform whereby said face board can be swiveled such that an upper surface thereof or an underside thereof faces upward;

wherein said base is provided in one side wall thereof with an opening in communication with said compartment for disposing a drawer in said compartment via said opening; and wherein a top of said drawer is provided with a tray for collecting dust passing through a gap between said base and said face board.

19. A multifunctional work box comprising:

a base having a receiving compartment with an open top whereby said compartment is used to receive at least one article; and a face board pivoted to a top end of said base for covering said compartment and used as a workbench platform whereby said face board can be swiveled such that an upper surface thereof or an underside thereof faces upward; and wherein said base is provided in one side wall thereof with a saw receiver of a U-shaped cross section for keeping a saw.

20. A multifunctional work box comprising:

a base having a receiving compartment with an open top whereby said compartment is used to receive at least one article; and a face board pivoted to a top end of said base for covering said compartment and used as a workbench platform whereby said face board can be swiveled such that an upper surface thereof or an underside thereof faces upward;

wherein said base is provided in a bottom edge of two opposite side walls thereof with a locating plate which is provided with at least one through hole for receiving a fastening bolt whereby said fastening bolt is used to fasten said base on a workbench platform.

* * * * *